US007331183B2

(12) United States Patent
Askew

(10) Patent No.: US 7,331,183 B2
(45) Date of Patent: Feb. 19, 2008

(54) PERSONAL PORTABLE ENVIRONMENTAL CONTROL SYSTEM

(75) Inventor: Gregory K. Askew, Saint Inigoes, MD (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 339 days.

(21) Appl. No.: 11/250,710

(22) Filed: Oct. 3, 2005

(65) Prior Publication Data

US 2008/0006036 A1 Jan. 10, 2008

(51) Int. Cl.
*F25B 21/02* (2006.01)

(52) U.S. Cl. ..... 62/3.2; 62/3.7

(58) Field of Classification Search ..... 62/3.2, 62/3.5, 3.62, 3.7, 259.3
See application file for complete search history.

(56) References Cited

U.S. PATENT DOCUMENTS

| | | | | |
|---|---|---|---|---|
| 3,008,300 | A * | 11/1961 | Ryan | 62/3.3 |
| 3,205,666 | A * | 9/1965 | Gould et al. | 62/3.63 |
| 5,193,347 | A | 3/1993 | Apisdorf | |
| 5,197,294 | A | 3/1993 | Galvan et al. | |
| 5,800,490 | A | 9/1998 | Patz et al. | |
| 5,890,371 | A | 4/1999 | Rajasubramanian et al. | |
| 6,023,932 | A | 2/2000 | Johnston | |
| 6,298,907 | B1 | 10/2001 | Colvin et al. | |
| 6,393,842 | B2 | 5/2002 | Kim et al. | |
| 6,548,894 | B2 * | 4/2003 | Chu et al. | 257/706 |
| 6,815,814 | B2 * | 11/2004 | Chu et al. | 257/722 |
| 6,823,678 | B1 | 11/2004 | Li | |
| 6,858,068 | B2 | 2/2005 | Smith et al. | |
| 6,915,641 | B2 * | 7/2005 | Harvie | 62/3.5 |
| 6,948,322 | B1 * | 9/2005 | Giblin | 62/3.5 |
| 7,117,687 | B2 * | 10/2006 | Naaman | 62/259.3 |
| 7,178,344 | B2 * | 2/2007 | Bell | 62/3.7 |
| 7,231,777 | B1 * | 6/2007 | Arnold et al. | 62/259.3 |
| 7,249,464 | B1 * | 7/2007 | Watson | 62/3.2 |
| 7,272,946 | B2 * | 9/2007 | Ichigaya | 62/259.3 |
| 2005/0075593 | A1 * | 4/2005 | Smith et al. | 602/2 |

FOREIGN PATENT DOCUMENTS

JP 11-294889 A * 10/1999

* cited by examiner

*Primary Examiner*—Mohammad M. Ali
(74) *Attorney, Agent, or Firm*—Mark O. Glut

(57) ABSTRACT

A personal portable environmental control system, which includes a thermoelectric device, two heat sinks, an exhaust fan for blowing ambient air across one heat sink and a blower for blowing ambient air across the other heat sink such that the blown air is conditioned (either heated or cooled). The thermoelectric device is disposed between the two heat sinks.

12 Claims, 4 Drawing Sheets

PERSONAL PORTABLE ENVIRONMENTAL CONTROL SYSTEM

STATEMENT OF GOVERNMENT INTEREST

The invention described herein may be manufactured and used by or for the Government of the United States of America for governmental purposes without payment of any royalties thereon or therefor.

BACKGROUND

The present invention relates to a personal portable environmental control system. More specifically, but without limitation, the present invention relates to a wearable air cooling and heating system.

Military operations, as well as other similar operations, often require being in extreme environments that can be very cold or very hot. Personal environmental control systems may be very helpful to users in that they may increase comfort to the user as well as allow greater concentration on the mission. In extreme cold, added clothing may be too bulky or not adequate. In extreme heat there are few if any alternatives. Therefore, a need exists to provide heating and cooling to personnel involved in varying temperature environments to improve overall performance while completing assigned tasks.

Thus, there is a need in the art to provide a portable environmental system without the limitations inherent in present methods.

SUMMARY

The present invention is directed to a personal portable environmental control system, which includes a thermoelectric device, two heat sinks, an exhaust fan for blowing ambient air across one of the heat sinks, and a blower for blowing ambient air across the other heat sink such that the blown air is conditioned (either heated or cooled).

It is a feature of the present invention to provide conditioned air (cooled or heated) to personnel involved in varying temperature environments.

It is a feature of the invention to provide a personal portable environmental control system that is a wearable air cooling/heating system. It is also a feature of the invention to provide a personal portable environmental control system that minimizes any restriction to the movement of the user.

BRIEF DESCRIPTION OF THE DRAWINGS

These and other features, aspects and advantages of the present invention will become better understood with reference to the following description and appended claims, and accompanying drawings wherein:

DETAILED DESCRIPTION OF THE INVENTION

Figure 1:
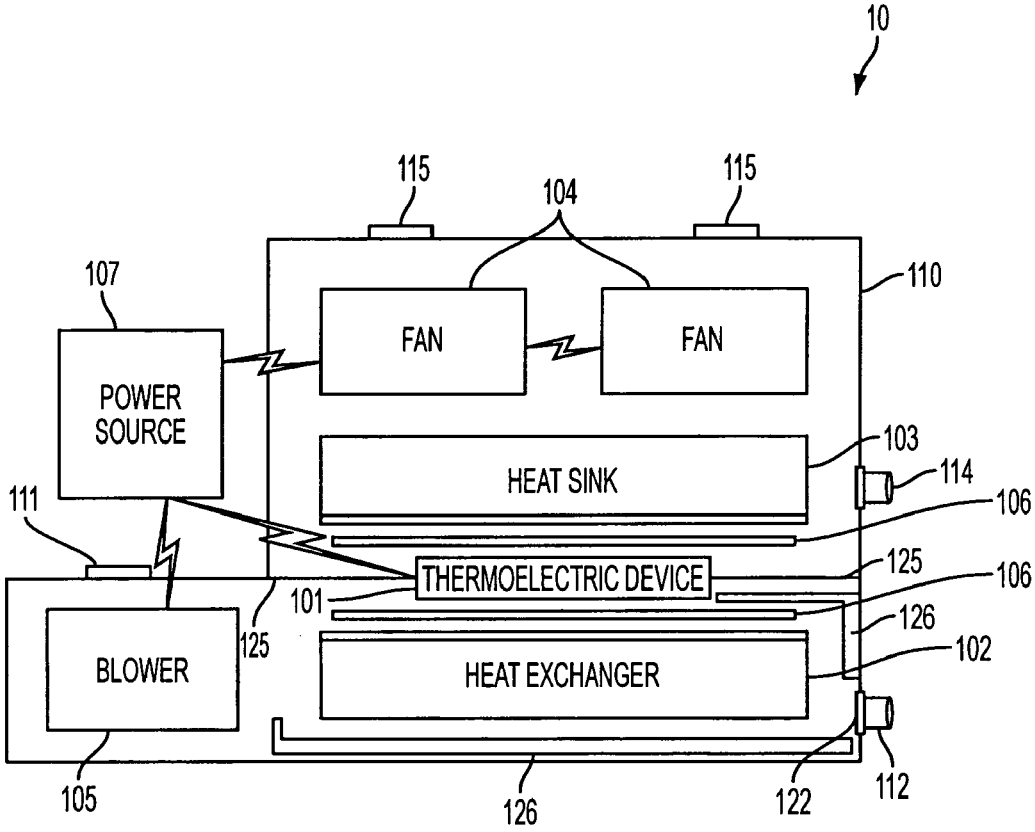
FIG. 1 is an internal schematic view of an embodiment of the personal portable environmental control system.

The preferred embodiment of the present invention is illustrated by way of example below and in FIGS. 1-5. As seen in FIG. 1, the personal portable environmental control system 10 includes a thermoelectric device 101, two heat sinks 102 and 103, exhaust fans 104 and a blower 105. One of the heat sinks may be a heat exchanger 102, while the other heat sink may be an exhaust heat sink 103. The thermoelectric device 101 is disposed between the heat exchanger 102 and the exhaust heat sink 103. The exhaust fans 104 blow ambient air across the exhaust heat sink 103 such that excess heat/cold is removed; and the blower 105 blows ambient air across the heat exchanger 102 such that the blown air blown by the blower 105 is conditioned (either heated or cooled), which cools or heats the user.

In the discussion of the present invention, the invention will be discussed in a military environment; however, this invention can be utilized for any type of need that requires or lends itself to a personal portable environmental control system. Examples in which the invention may be utilized include, but without limitation, exercise, recreation, motor sports, fire and rescue missions or any type of need which requires cooling and/or heating.

A thermoelectric device 101 may be defined, but without limitation, as a device or apparatus that generates heat or coolness by electricity. The thermoelectric device 101 may be a heat pump, a thermoelectric generator or any type of thermoelectric device deemed practicable. Typically a thermoelectric device 101 is a flat rectangle with two main surfaces disposed opposite of each other. When electricity is passed through a thermoelectric device 101, one main surface of the thermoelectric device 101 becomes cold while the other main surface becomes hot. By switching the polarity of the electricity, a user can switch which surface becomes hot or cold, thus controlling whether the user is heated or cooled. In an embodiment of the invention, the thermoelectric device 101 is sealed to prevent moisture intrusions. The thermoelectric device 101 may also provide about 80 Watts of cooling at about 16.1 VDC and about 8.1 amps DC. In an embodiment of the invention, the thermoelectric device 101 includes an array of Bismuth Telluride semiconductor pellets that have been doped so that one type of charge carrier—either positive or negative—carries the majority of current. Pairs of positive/negative pellets are configured so they are connected electrically in series, but thermally in parallel. The pellets may be placed on metalized ceramic substrates with small conductive tabs connecting the pellets. The pellets, tabs, and substrates may form a layered configuration. The preferred thermoelectric device is a model CZ1-1.4-127.1.14 thermoelectric device manufactured by Tellurex Corporation.

A heat exchanger 102 may be defined, but without limitation, as a cooler or a device used to transfer heat between two fluids or items without direct contact between them. The heat exchanger 102 may be manufactured from an aluminum alloy; however, the heat exchanger 102 may be manufactured from any type of material practicable.

An exhaust heat sink 103 may be defined, but without limitation, as an area where an apparatus transfers the heat it takes from a heat source. The exhaust heat sink 103 may be manufactured from an aluminum alloy; however, the exhaust heat sink 103 may be manufactured from any type of material practicable.

Figure 2:
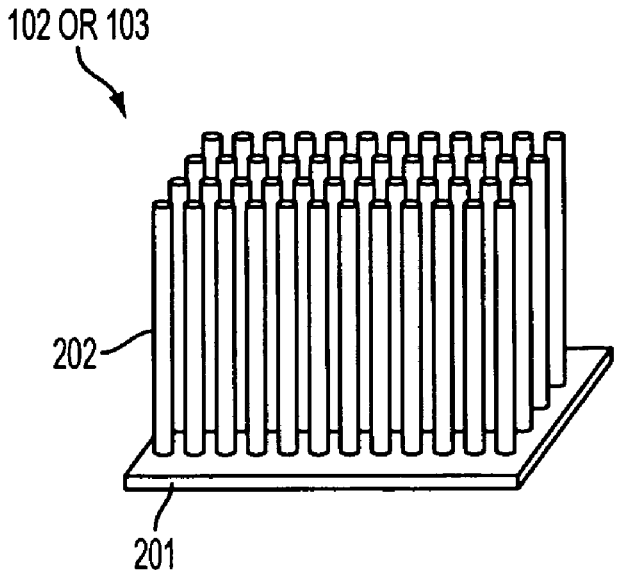
FIG. 2 is a perspective view of an embodiment of a heat sink.
Figure 3:
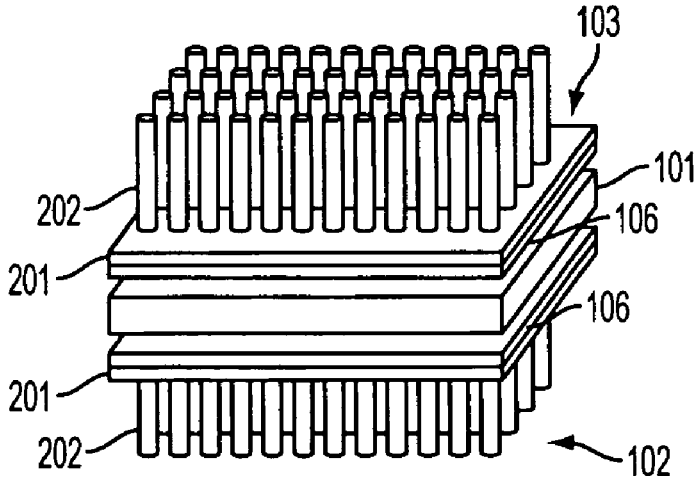
FIG. 3 is a perspective view of an embodiment of the thermoelectric device, the heat exchanger and the heat sink.

The exhaust heat sink 103 and the heat exchanger 102 may be substantially similar and be the same type of heat sink. In an embodiment of the invention, both the heat exchanger 102 and the exhaust heat sink 103 utilize a pin fin construction, which provides turbulent airflow necessary to achieve the heat exchange necessary for efficient operation. As shown in FIG. 2, a heat sink (specifically the heat exchanger 102 and the exhaust heat sink 103) that utilizes the pin fin construction has a base 201 with a plurality of cylinders 202 extending from the base 201. The cylinders 202 may be substantially perpendicular to the base 201. The base 201 may be rectangular in shape or any shape practicable. The cylinders 202 may be substantially similar in size and shape and may be dispersed evenly throughout the base 201. In another embodiment of the invention, the cylinders may be randomly dispersed, arranged in rows, or in any type of configuration practicable. In the preferred embodiment, as seen in FIG. 3, the bases 201 of the two heat sinks (the heat exchanger 102 and the exhaust heat sink 103) are in thermodynamic communication with and are facing toward the thermoelectric device 101. Specifically, the base 201 of the heat exchanger 102 is in thermodynamic communication with one of the main surfaces of the thermoelectric device 101 (hot or cold depending on whether the user wants to be cooled or heated), while the base 201 of the exhaust heat sink 103 is in thermodynamic communication with the other main surface of the thermoelectric device 101.

In an embodiment of the invention, the base 201 of both the heat exchanger 102 and the exhaust heat sink 103 is manufactured from an aluminum alloy that includes aluminum, magnesium and silicon. The preferred aluminum alloy for the base 201 is about 0.4 to about 0.8% silicon, about 0.7% iron, about 0.15 to about 0.4% copper, about 0.15% manganese, about 0.8% to about 1.2% magnesium, about 0.04% to about 0.35% chromium, about 0.25% zinc, about 15% titanium, with the remaining percentage being aluminum. The alloy may be thermally treated, solution heat treated and artificially aged. The alloy may also be stress relieved by stretching to produce a specified amount of permanent set subsequent to solution heat treating and prior to precipitation heat treating. The alloy may have an ultimate tensile strength of about 18 ksi to about 45 ksi, a yield strength of about 8 ksi to about 40 ksi, a Brinell Hardness of about 30 to about 95, a shear strength of about 12 ksi to about 30 ksi, a melting range of about 1080° F. to about 1205° F., and a nominal density of about 0.098 lbs/cu. in. The preferred aluminum alloy for the base 201 of both the heat exchanger 102 and the exhaust heat sink 103 is Alum 6061 T651.

In an embodiment of the invention, the cylinders 202 of both the heat exchanger 102 and the exhaust heat sink 103 are manufactured from a material that is about 99% or greater pure aluminum. The preferred material for the cylinders 202 of both the heat exchanger 102 and the exhaust heat sink 103 is Alum 1380.

In one of the embodiments of the invention, as seen in FIG. 1, there are two exhaust fans 104 for blowing ambient air over the exhaust heat sink 103. However, the system may utilize as many exhaust fans 104 or blowers 105 as needed or desired. The exhaust fans 104 help remove excess intensity in temperature of ambient air around the exhaust heat sink 103 (i.e. remove the excess heat or cold).

In an embodiment of the invention, the blower 105 may be electronically controlled or computer controlled to provide various on/off cycle times. The blower intake may be filtered such that ambient air is cleaned to prevent biological or chemical hazards from entering the system 10.

As seen in FIGS. 1 and 3, the personal portable environmental control system 10 may also include thermo-conductive material 106. Thermo-conductive material 106 may be defined, but without limitation, as a material that makes easy heat flow between electronic components and a heat exchanger/heat sink. The thermo-conductive material 106 may be disposed between the base 201 of the exhaust heat sink 103 and the thermoelectric device 101 (specifically one of the main surfaces), and between the base 201 of the heat exchanger 102 and the thermoelectric device 101 (specifically the other main surface). The thermo-conductive material 106 may be in one or more pieces. The preferred thermo-conductive material 106 protects the system from weather conditions and is puncture-resistant. The preferred thermo-conductive material 106 may also be characterized by chemical resistance to oxidation and the effects of aqueous solutions of acids, alkalis, salts, sulphur dioxide and ammonia. The preferred embodiment of the thermo-conductive material 106 has a wide range of working temperature, preferably from about −50° C. up to about 200° C. The thermo-conductive material 106 may also be non-adhesive, non-hardening, and a thermally conductive silicone filled paste. The preferred thermo-conductive material 106 is Omegatherm® 201 Silicone Paste.

The system 10 may also include a power source 107 for the thermoelectric device 101, the exhaust fan(s) 104, and the blower 105. The power source 107 may be in electrical communication with the thermoelectric device 101, the exhaust fan(s) 104, and the blower 105. The power source 107 may be a DC power source, which may be a battery or batteries, vehicle power, AC power that has been converted to DC, or any type of DC power source practicable. The preferred power source 107 is a rechargeable sealed Lithium ion battery. However, any type of power source 107 that is practicable may be used.

Figure 4:
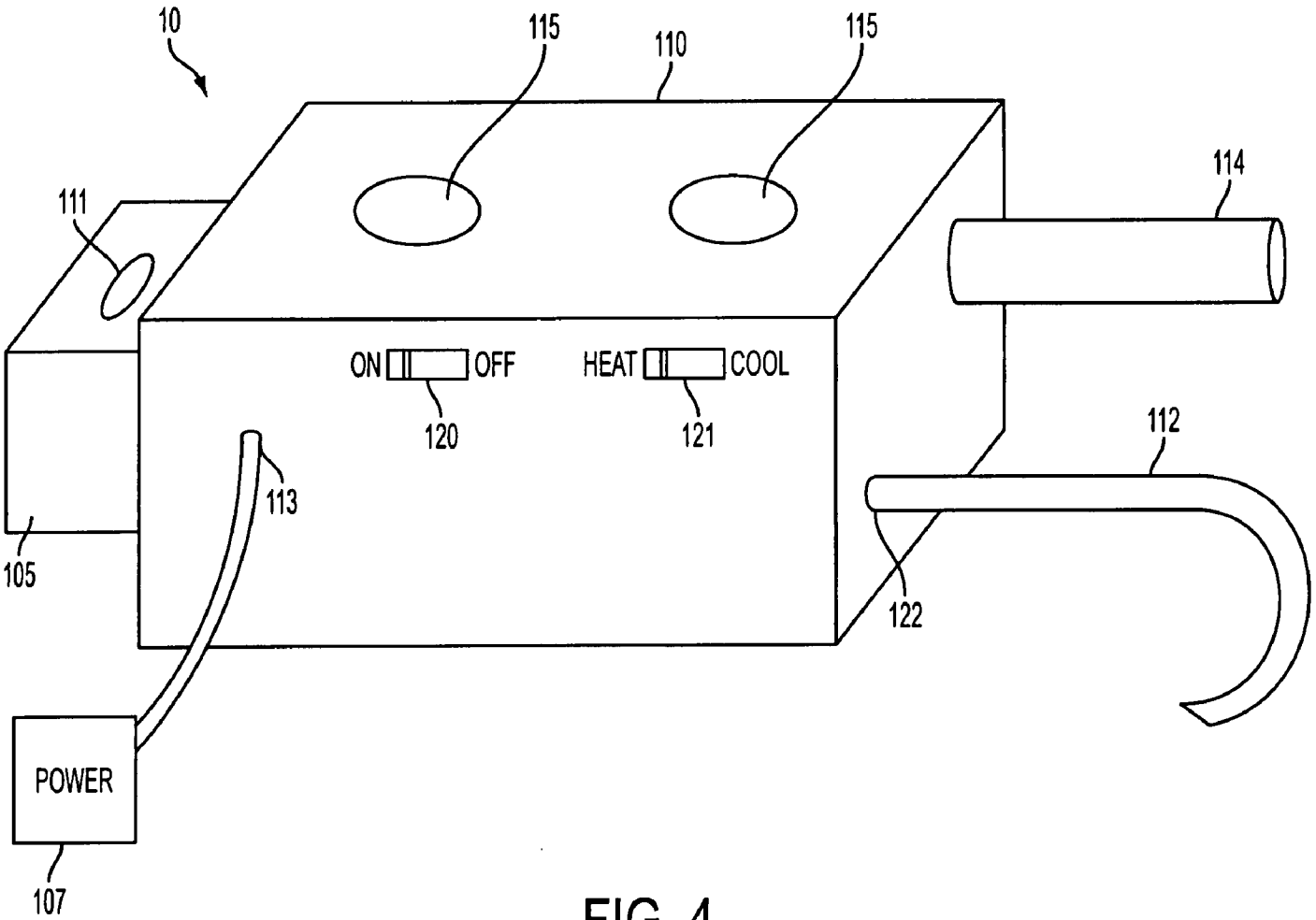
FIG. 4 is a perspective view of an embodiment of the personal portable environmental control system.

As seen in FIGS. 1 and 4, in one of the embodiments of the invention, the thermoelectric device 101, the two heat sinks 102 and 103, the exhaust fan(s) 104, and the blower 105 may be disposed within an enclosure 110. The enclosure 110 may be sealed to minimize moisture and/or particle intrusion. The power source 107 may be attached to the enclosure 110 via a power source plug 113. The power source plug 113 allows electrical communication between the power source 107 and the thermoelectric device 101, the exhaust fan(s) 104, and the blower 105. The power source 107 may be outside the enclosure 110 so that the power source 107 can be easily replaced and/or be interchangeable with another power source 107.

In operation, in one of the embodiments of the invention, a power source 107 is electrically communicating with the thermoelectric device 101, the exhaust fan(s) 104, and the blower 105. A DC voltage from the power source 107 is applied to the thermoelectric device 101 and controlled via an on/off switch 120 on the outside portion of the enclosure 110. One surface of the thermoelectric device 101 becomes hot while the other surface becomes cold. By switching the polarity of the voltage the surface that became hot becomes cold, and vice versa. The polarity of the DC voltage source determines whether heating or cooling is provided. This can be controlled by a heat/cool switch 121 placed on the outside portion of the enclosure 110. When the system 10 is turned on via the on/off switch 120, the exhaust fans 104 intake ambient air via exhaust fan intake vents 115. Exhaust fans 104 blow the ambient air across the exhaust heat sink 103 to help remove the waste heat/cold air. This air is further blown by the exhaust fans 104 out of the enclosure 110, exiting via an exhaust vent 114. The blower 103 may intake ambient air via a blower intake vent 111, then blow the air across the heat exchanger 102 such that the air becomes conditioned, and then blow the air toward a conditioned air vent 122 which is in fluid communication with a hose 112. The conditioned air (either heated or cooled) then travels via the hose 112 toward the user. The exhaust fans 104 and the exhaust heat sink 103 may be separated and environmentally sealed from the blower 105 and the heat exchanger 102 by a partition 125 so that the conditioned air is not thermodynamically affected by the waste heat/cold air. In addition, the heat exchanger 102 may be surrounded by insulation 126 to minimize heat exchange with the environment. The insulation 126 may be for example, but without limitation, closed cell foam. The preferred closed cell foam has a thermal conductivity (W/(m-K)) of: about 0.036 at about −20° C., about 0.037 at about −10° C., 0.038 at about 0° C., about 0.040 at about 20° C., about 0.042 at about 40° C., about 60° C.

Figure 5:
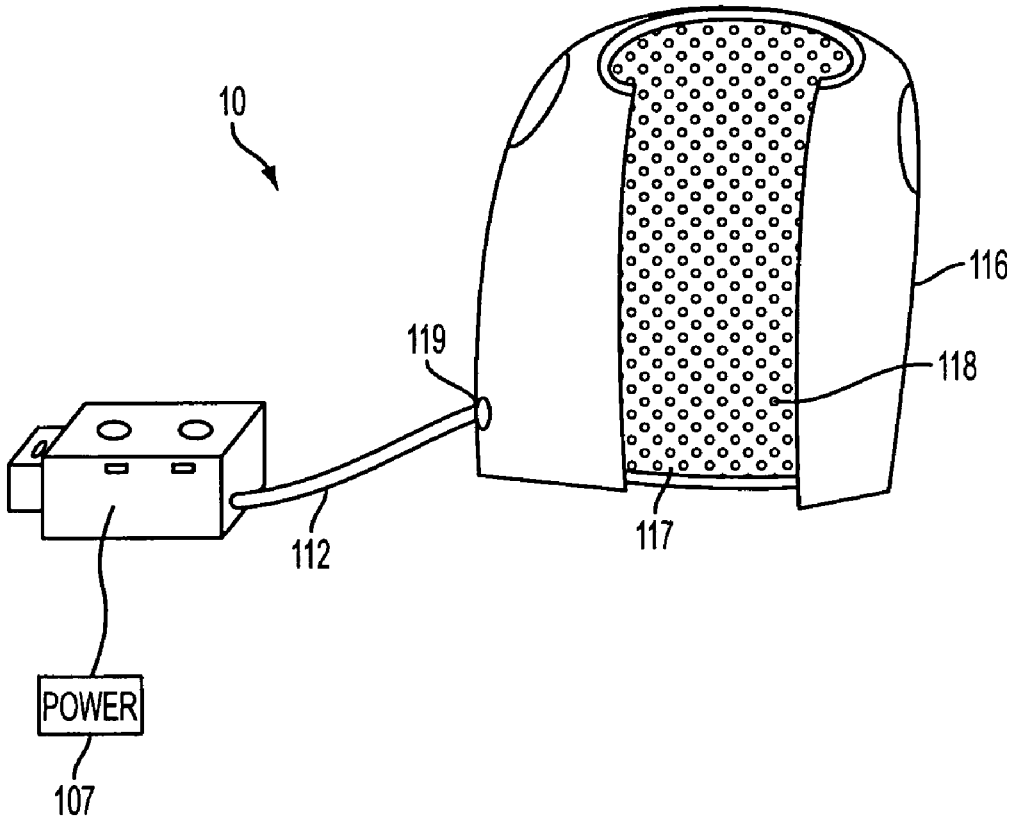
FIG. 5 is a perspective view of an embodiment of the personal portable environmental control system.

In one of the embodiments of the invention, the hose 112 is attached to clothing 116 that allows air to be distributed to a portion of a user's body. For example, as seen in FIG. 5, but without limitation, the user may wear clothing 116 that has an intake valve 119 that is in fluid communication with the hose 112. The intake valve 119 allows the conditioned air to enter a bladder system. In the preferred embodiment, the bladder system is a nonporous bladder 117 that is not permeable by air.

The nonporous bladder 117 may include a plurality of holes 118 that allow conditioned air to exit the nonporous bladder 117. In an embodiment of the invention, the plurality of holes 118 may only be located on the interior of the clothing 116 and only allow the conditioned air to exit toward the interior of the clothing 116 such that no conditioned air is directed away from the user. The clothing 116 may be, but without limitation, a vest, jacket, pants or any type of wearable item.

The hose 112 may be attached to an open loop system as described or a closed loop system that recirculates the air. The system 10 may be carried by the user via a holster that can be worn on a belt, on the chest, back, or anywhere practicable. In an embodiment of the invention, the power source 107 is in one holster, while the rest of the system 10 or the enclosure 110 (with various elements disposed within it) is disposed in another holster.

When introducing elements of the present invention or the preferred embodiment(s) thereof, the articles "a," "an," "the," and "said" are intended to mean there are one or more of the elements. The terms "comprising," "including," and "having" are intended to be inclusive and mean that there may be additional elements other than the listed elements.

Although the present invention has been described in considerable detail with reference to certain embodiments thereof, other embodiments are possible. Therefore, the spirit and scope of the appended claims should not be limited to the description of the preferred embodiment contained herein.

What is claimed is:

1. A personal portable environmental control system, comprising:

a thermoelectric device, wherein when a DC voltage is applied to the thermoelectric device a hot surface and a cold surface are created, wherein the thermoelectric device provides about 80 Watts of cooling at about 16.1 VDC and about 8.1 amps DC;

a heat exchanger, the heat exchanger utilizing a pin fin construction, the heat exchanger manufactured from an aluminum alloy;

an exhaust heat sink, the exhaust heat sink utilizing a pin fin construction and manufactured from an aluminum alloy, the thermoelectric device disposed between the heat exchanger and the exhaust heat sink, the heat exchanger in thermodynamic communication with one of the surfaces of the thermoelectric device, while the exhaust heat sink is in thermodynamic communication with the other surface of the thermoelectric device;

an exhaust fan for blowing ambient air over the exhaust heat sink;

a blower for blowing ambient air across the heat exchanger such that the blown air is conditioned, the blower providing the conditioned air to a user;

an enclosure wherein the heat exchanger, the exhaust heat sink, the exhaust fan and the blower are disposed within the enclosure, the enclosure sealed to minimize moisture and particle intrusion; and, thermo-conductive material, the thermo-conductive material disposed between the exhaust heat sink and the thermoelectric device, and between the heat exchanger and the thermoelectric device.

2. The personal portable environmental control system of claim 1, wherein the system further includes a power source, the power source providing power to the thermoelectric device, the exhaust fun and the blower.

3. The personal portable environmental control system of claim 2, wherein the power source is a battery.

4. The personal portable environmental control system of claim 3, wherein the power source is a rechargeable sealed Lithium ion battery.

5. The personal portable environmental control system of claim 4, wherein the system further includes a hose, the hose providing conditioned air to a user.

6. The personal portable environmental control system of claim 5, wherein the system further includes clothing, the clothing attached to the hose, the clothing allowing the conditioned air from the hose to be distributed to at least a portion of the user's body.

7. The personal portable environmental control system of claim 6, wherein the clothing has a bladder system with holes that allows conditioned air to exit the holes adjacent to the user's body.

8. The personal portable environmental control system of claim 7, wherein the thermo-conductive material has a working temperature range from about −50° C. to about 200° C.

9. The personal portable environmental control system of claim 1, wherein the heat exchanger and the exhaust heat sink each include a base and a plurality of cylinders, the cylinders extending from the base.

10. The personal portable environmental control system of claim 9, wherein the base of the heat exchanger is in thermodynamic communication with one of the surfaces of the thermoelectric device while the base of the exhaust heat sink is in thermodynamic communication with the other surface of the thermoelectric device.

11. The personal portable environmental control system of claim 10, wherein the base of both the exhaust heat sink and the heat exchanger is manufactured from an aluminum alloy that includes aluminum, magnesium and silicon.

12. The personal portable environmental control system of claim 11, wherein the cylinders of both the exhaust heat sink and the heat exchanger are manufactured from a material that is about 99% or greater pure aluminum.

* * * * *